US008063834B2

(12) United States Patent
Boyle

(10) Patent No.: US 8,063,834 B2
(45) Date of Patent: Nov. 22, 2011

(54) MOBILE TELEPHONE WITH A BUILT-IN PLANAR TELEVISION ANTENNA ADAPTED FOR RADIOTELEPHONE SIGNAL REJECTIONS

(75) Inventor: Kevin R. Boyle, Horsham (GB)

(73) Assignee: NXP B.V., Eindhoven (NL)

( * ) Notice: Subject to any disclaimer, the term of this patent is extended or adjusted under 35 U.S.C. 154(b) by 536 days.

(21) Appl. No.: 11/720,833

(22) PCT Filed: Nov. 30, 2005

(86) PCT No.: PCT/IB2005/053962

§ 371 (c)(1),
(2), (4) Date: Aug. 25, 2009

(87) PCT Pub. No.: WO2006/059279

PCT Pub. Date: Jun. 8, 2006

(65) Prior Publication Data

US 2009/0305738 A1 Dec. 10, 2009

(30) Foreign Application Priority Data

Dec. 2, 2004 (EP) ..... 04257502

(51) Int. Cl.
*H01Q 1/24* (2006.01)
*H01Q 1/38* (2006.01)

(52) U.S. Cl. ..... 343/702; 343/700 MS

(58) Field of Classification Search ..... None
See application file for complete search history.

(56) References Cited

U.S. PATENT DOCUMENTS

| | | | | |
|---|---|---|---|---|
| 50,643 | A | 10/1865 | Thacker | |
| 7,236,137 | B2 | 6/2007 | Yoshino et al. | |
| 7,521,463 | B2 * | 4/2009 | Hayashi et al. | 514/345 |
| 7,848,771 | B2 * | 12/2010 | Boyle | 455/550.1 |
| 2004/0072589 | A1 | 4/2004 | Hamamura et al. | |
| 2005/0093749 | A1 * | 5/2005 | Purr et al. | 343/702 |
| 2007/0040751 | A1 * | 2/2007 | Boyle | 343/702 |
| 2008/0096604 | A1 * | 4/2008 | Yamazaki et al. | 455/553.1 |
| 2009/0131129 | A1 * | 5/2009 | Yamazaki et al. | 455/575.7 |

FOREIGN PATENT DOCUMENTS

| | | |
|---|---|---|
| JP | 10-107533 | 4/1998 |
| JP | 2003-133844 | 5/2003 |
| JP | 2003-179426 | 6/2003 |

* cited by examiner

*Primary Examiner* — Trinh Dinh

(57) ABSTRACT

A mobile telephone comprises a casing housing a telephone set to receive and transmit radiotelephone signals and a television set comprising a main television antenna (MAN) to receive radiotelevision signals, a television receiver arranged to process the received radiotelevision signals to output television signals to be displayed, and a display means display the outputted television signals. The main television antenna (MAN) is made in planar technology, is built-in inside the casing and comprises a filtering slot (FS) having chosen dimensions (D1, D2) to be resonant around the frequency of the radiotelephone signals to reject them at least partly.

19 Claims, 4 Drawing Sheets

MOBILE TELEPHONE WITH A BUILT-IN PLANAR TELEVISION ANTENNA ADAPTED FOR RADIOTELEPHONE SIGNAL REJECTIONS

RELATED APPLICATIONS

This application is a 371 of PCT/IB2005/053962 filed Nov. 30, 2005, which claims priority under 35 U.S.C. 119 to an application EPO 04257502.7 filed on Dec. 2, 2004, the contents of which are incorporated herein by reference.

FIELD OF THE INVENTION

The present invention relates to the domain of communication devices such as mobile telephones, and more precisely to the mobile telephones adapted to display television pictures.

Some mobile telephones comprise a telephone set to receive and transmit radiotelephone signals, but also a television set to receive radiotelevision signals. Such a television set usually comprises a main television antenna to receive the radiotelevision signals, a television receiver arranged to process these received radiotelevision signals to output television signals to be displayed, and a display means to display these outputted television signals.

The mobile television band extending from approximately 470 MHz to 714 MHz (with a bandwidth of 41% centered at 592 MHz), at the band center frequency half a wavelength is approximately equal to 25 cm which is similar to the size of a "clam-shell" or "flip" mobile telephone when its casing is opened to reveal the inner screen or keypad.

BACKGROUND OF THE INVENTION

Therefore, the main television antenna generally comprises a retractable rigid or telescopic element housed inside the telephone casing and which must be extracted from it and "unfolded" to extend to a length approximately equal to a quarter of the wavelength signals in order to allow signal reception.

With such an arrangement the quality of the radiotelevision signal reception strongly relies on the ability of the user to correctly unfold and orientate the main television antenna.

Moreover, when this antenna is unfolded it increases the bulkiness of the mobile telephone and the design of the latter may become unaesthetic.

To improve the situation it has been proposed to use a main television antenna built-in inside the telephone casing. More precisely, to allow a signal reception in the mobile television band it has been proposed to use a Planar Inverted F Antenna (PIFA) mounted on the printed circuit board (PCB) of the mobile telephone. Such an arrangement is notably described in patent document US 2001/0050643.

This antenna allows effectively to receive signals in the mobile television band, but its bandwidth is normally too narrow to allow a signal reception over the television band (for the antenna heights allowable in mobile phones). Moreover, since this antenna is not adapted to reject the radiotelephone signals, interference may occur between television and radiotelephone signals, which may induce a quality degradation of the displayed television pictures.

SUMMARY OF THE INVENTION

So, the object of this invention is to improve the situation.

For this purpose, the invention provides a mobile telephone comprising a casing housing a telephone set to receive and transmit radiotelephone signals and a television set comprising a main television antenna to receive radiotelevision signals, a television receiver arranged to process these received radiotelevision signals to output television signals to be displayed, and a display means to display these outputted television signals.

This mobile telephone is character in that its main television antenna is made in planar technology, is built-in inside its casing and comprises a filtering slot having chosen dimensions to be resonant around (or approximately at) the frequency of the radiotelephone signals to reject them at least partly.

Such a filtering slot acting as a high quality factor filter, the antenna may efficiently reject the radiotelephone signals.

At least two different types of planar antenna may be envisaged.

A first type comprises a modified PIFA antenna comprising:

- An L-shaped radiating element settled in a first plane approximately parallel to a ground plane (located on a face of a printed circuit board), and at a first chosen distance from this ground plane,
- feed and shorting planar pins having:
  - i) first parts substantially parallel to each other, respectively connected to the television receiver and to the ground plane and running approximately parallel to this ground plane over a second chosen distance,
  - ii) second parts substantially parallel to each other and extending from the first parts in a direction approximately perpendicular to the ground plane and over the first chosen distance, and
  - iii) third parts extending from the second parts in approximately the first plane and respectively connected to first and second extremities of the short and long portions of the L-shaped radiating element, and having portions running substantially parallel to each other and to the long portion of the L-shaped radiating element, and
- the filtering slot being defined between the third part portion of the feed pin and the short and long portions of the L-shaped radiating element.

This main planar antenna may have a bandwidth depending on the first and second chosen distances. For instance its bandwidth may be approximately proportional to the sum of the first and second chosen distances.

A second type comprises a single-pole antenna which may comprise, for instance:

- a U-shaped conductor, mounted above a ground plane located on a face of a printed circuit board, and comprising:
  - i) first and second parallel portions, having a first portion extremity connected to the television receiver, and
  - ii) a shorting portion running approximately perpendicularly between the first and second parallel portions at an intermediate level located at a chosen distance from a second portion extremity,
- the filtering slot then being defined between the shorting portion and the parts of the first and second portions which comprise their respective first and second portion extremities.

The second portion of the U-shaped conductor may be shorter than its first portion.

Moreover, the U-shaped conductor may be connected to a series of vias arranged to reduce the power loss in a dielectric part of the printed circuit board.

The mobile telephone according to the invention may have additional characteristics considered separately or combined, and notably:

- an auxiliary television antenna connected to the television receiver to feed it with received radiotelevision signals; this auxiliary television antenna may be a retractable whip antenna adapted to be housed inside the casing when it is not used, or it may be located in a pluggable earphone wire;
- the casing may comprise first and second parts connected to each other and defining a "clam-shell" structure or a "flip" structure, the first casing part housing a keypad and the second casing part housing the display means; the main television antenna may be housed inside the first or second casing part.
- a switching circuit may comprise at least one matching network to switch over at least one chosen sub-band received by the main planar television antenna and/or the auxiliary television antenna;
  the switching circuit may comprise at least three matching networks together comprising switches of the "single pole, single throw" (SPST) type, adapted to switch over three sub-bands depending on their respective states and combined with chosen inductors and capacitors for tuning the antenna frequency to a central frequency of one of these sub-bands. These switches may be PIN diodes, GaAs FETs or MEMS devices, for instance. Moreover, each switch may be combined with a varactor diode.

BRIEF DESCRIPTION OF THE DRAWINGS

Other features and advantages of the invention will become apparent on examining the detailed specifications hereafter and the appended drawings, wherein.

The appended drawings may not only serve to complete the invention, but also to contribute to its definition, if need be.

DESCRIPTION OF PREFERRED EMBODIMENTS

Figure 1:
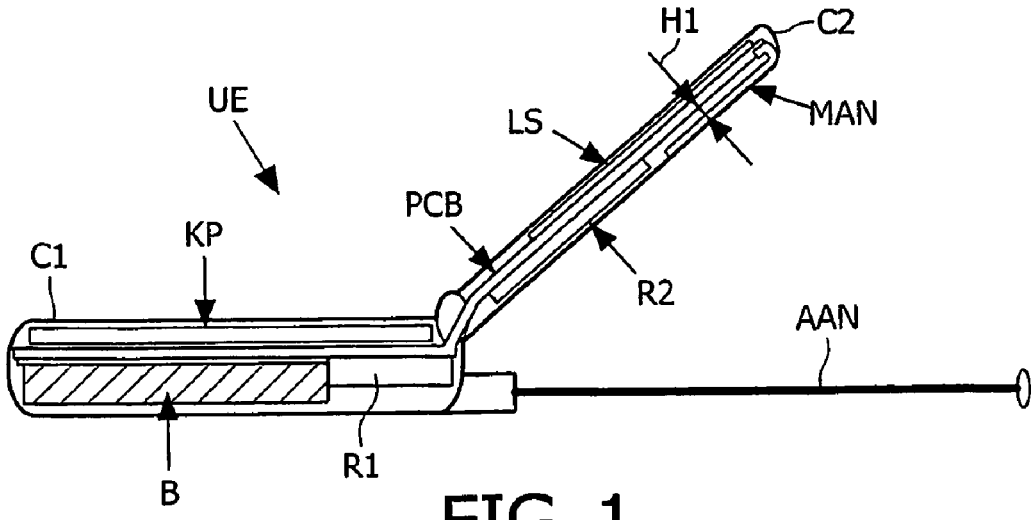
FIG. 1 schematically illustrates an example of clam-shell mobile telephone provided with a first example of embodiment of a built-in planar antenna according to the invention, FIG. 2 details the first example of embodiment of the built-in planar antenna appearing in FIG. 1, FIG. 3 schematically illustrates an example of a switching circuit for a television receiver adapted to process radiotelevision signals received by a built-in planar antenna according to the invention, FIG. 4 schematically illustrates a second example of an embodiment of a built-in planar antenna according to the invention, and FIG. 5 details the second example of an embodiment of the built-in planar antenna appearing in FIG. 4.
Figure 2:
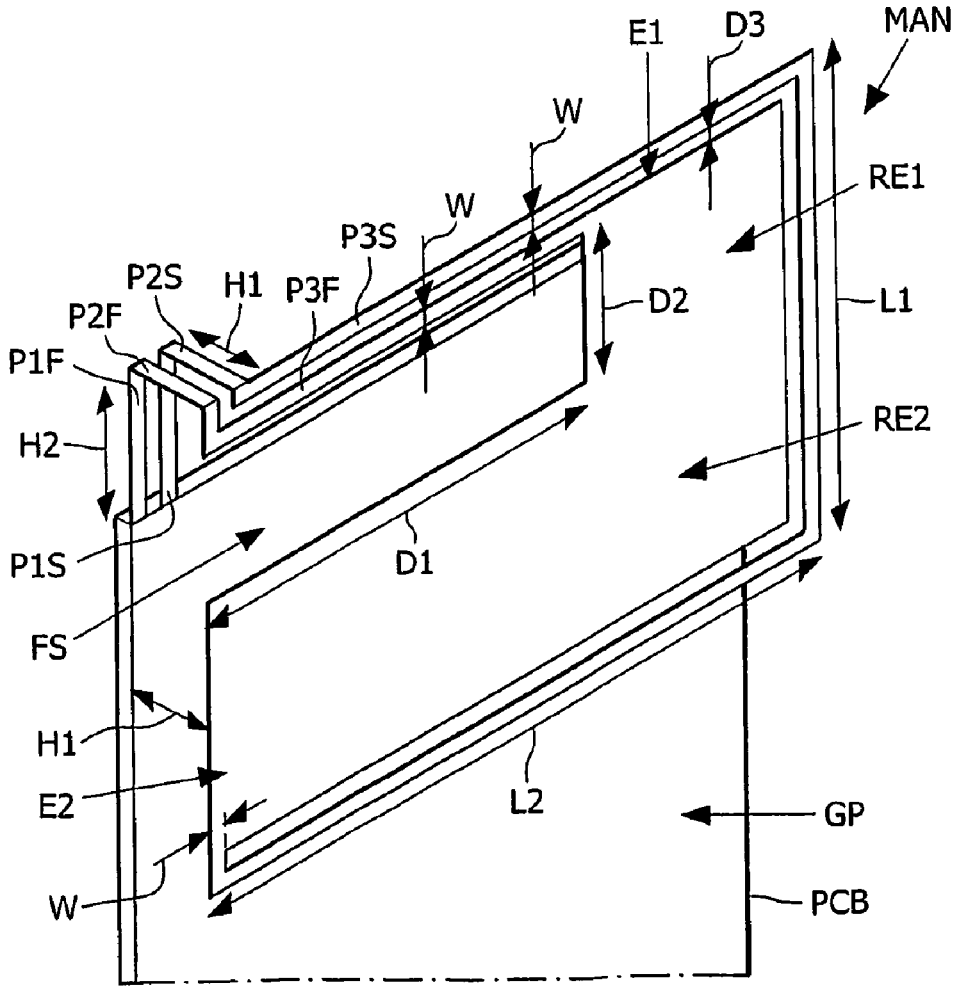

Reference is initially made to FIG. 1 and FIG. 2 to describe a mobile telephone UE provided with a first example of an embodiment of a built-in planar antenna MAN according to the invention.

In the following description it will be considered that the mobile telephone is a GSM telephone adapted to radio communication in a GSM network, and more precisely arranged to transmit and receive data packets to and from base stations (BTSs) of the GSM network. But it is important to notice that the invention is not limited to this type of mobile telephone. Indeed the invention concerns any type of mobile telephone adapted to radio communication in any type of (cellular) radio communication network, and notably AMPS, CDMA and UMTS, for example.

Moreover, by "mobile telephone" is meant here any type of communication equipment adapted to exchange (transmit/receive) radiotelephone signals and to receive radiotelevision signals.

The invention mainly relates to the television antenna(s) of the mobile telephone and possibly its television receiver. Therefore hereafter the mobile telephone components that are not related to in the invention and are supposed to be known by those skilled in the art will not be described.

Let be recalled, as illustrated in FIG. 1, that the GSM telephone UE according to the invention comprises a keypad KP, a battery B, a telephone set, comprising a telephone antenna (not shown) arranged together with a telephone receiver R1 to receive and transmit radiotelephone signals (hereafter named "GSM signals"), and a television set, comprising at least a main television antenna MAN to receive radiotelevision signals (hereafter named "television signals") and a television receiver R2 arranged to process the received television signals in order to be displayed by a display means such as an LCD screen LS.

All these GSM telephone components are housed, at least partly, inside a casing C1, C2. For instance and as illustrated in FIG. 1, the casing has first C1 and second C2 pieces connected to each other to define what is generally named a "clam-shell" or "flip" structure which must be opened to reveal the inner screen LS and/or the keypad KP. But the invention also applies to a casing in one piece.

In the illustrated example, the keypad KP, the telephone receiver R1 and the battery B are housed inside the first casing piece C1, while the screen LS, the television receiver R2 and the main television antenna MAN are housed inside the second casing piece C2. It is important to notice that the television receiver R2 and/or the main television antenna MAN might be housed inside the first piece C1.

As illustrated in FIG. 1, the GSM telephone UE may be provided with an auxiliary television antenna AAN, connected to its television receiver R2, to increase the GSM signal reception. Such an auxiliary television antenna AAN may be a retractable whip antenna, as illustrated, but it may also be defined inside a pluggable earphone wire.

The television receiver R2 and the main television antenna MAN are mounted on a printed circuit board PCB provided with a metallic layer defining a ground plane on at least a part of its face.

According to the invention the main television antenna MAN is made in planar technology, is built-in inside the casing (here in the second casing piece C2) and comprises a filtering slot FS (FIG. 2). This filtering slot FS has chosen dimensions to be resonant around (or approximately at) the frequency of the GSM signals to reject them at least partly and preferably entirely. In other words, the filtering slot FS acts as a high quality factor (Q) filter adapted to GSM signal rejection. Normally this slot would be arranged to force the antenna impedance to an open circuit at the GSM centre frequency. However, it may also force the antenna impedance to a value, which gives minimum gain from the low-noise amplifier of the television receiver.

As will be described in detail hereafter, the planar antenna MAN according to the invention may be a modified Planar Inverted F Antenna (PIFA), such as the one illustrated in FIG. 1 and FIG. 2, or a single-pole antenna, such as the one illustrated in FIG. 4 and FIG. 5.

As illustrated in FIG. 2 a main PIFA antenna MAN, modified according to the invention, comprises a radiating element RE1, RE2 having an L shape and located in a first plane facing and parallel to the ground plane GP mounted on a face of the printed circuit board PCB. This radiating element RE1, RE2 is located at a first chosen distance H1 from the ground plane GP. This first distance H1 is chosen to control at least partly the bandwidth of the main PIFA antenna MAN.

The short and long portions of the L-shaped radiating element are respectively referenced RE1 and RE2 respectively.

The main PIFA antenna MAN also comprises a feed planar pin P1F-P3F (PF) and a shorting planar pin P1S-P3S (PS).

The feed (planar) pin (PF) comprises a first part P1F connected to the television receiver R2 (FIG. 1) through a dedicated integrated circuit (not shown) provided on the printed circuit board PCB. This first part P1F runs approximately in the plane of the ground plane GP over a second chosen distance H2.

This second distance H2 is also chosen to control at least partly the bandwidth of the main PIFA antenna MAN. In fact in this embodiment the bandwidth is approximately proportional to the sum of the first H1 and second H2 chosen distances.

The shorting (planar) pin (PS) comprises a first part P1S connected to the ground plane GP. This first part P1S runs also approximately in the plane of the ground plane GP over the second chosen distance H2 and substantially parallel to the first part P1F of the feed pin, at a chosen distance D3 from this one.

The feed pin further comprises a second part P2F extending from its first part P1F in a direction perpendicular to the ground plane GP and over the first chosen distance H1.

The shorting pin further comprises a second part P2S extending from its first part P1S in the direction approximately perpendicular to the ground plane GP and over the first chosen distance H1. This second part P2S runs substantially parallel to the second part P2F of the feed pin, at the chosen distance D3 from this one.

The feed pin still further comprises a third part P3F extending from its second part P2F in approximately the first plane (in which the radiating element RE1, RE2 is located) and connected to a first extremity E1 of the short portion RE1 of the L-shaped radiating element. This third part P3F comprises a portion, which runs approximately parallel to a side of the long portion RE2 of the radiating element.

The shorting pin still further comprises a third part P3S extending from its second part P2S in approximately the first plane and connected to a second extremity E2 of the long portion RE2 of the L-shaped radiating element. To reach this second extremity E2 the third part P3S runs along the portion of the third part P3F of the feed pin (parallel to RE2) and then along the short RE1 and long RE2 portions of the radiating element at the chosen distance D3.

With such an arrangement the filtering slot FS is defined between the portion of the third part P3F of the feed pin parallel to RE2) and the short RE1 and long RE2 portions of the L-shaped radiating element. So, in this example the shape of the filtering slot FS is approximately rectangular. But other shapes may be envisaged.

The dimensions D1 and D2 of the filtering slot FS are defined by the L shape of the radiating element RE1, RE2. These dimensions are of importance. The wider dimension D1 can be chosen predominantly to set the correct resonant frequency and then to filter (reject) the GSM signals in the 900 MHz region. The narrower dimension D2 can predominantly be used for impedance matching.

This arrangement allows a better coupling with the printed circuit board PCB and hence a more wideband impedance (from a low profile design).

In order for the main antenna MAN to have a sufficient bandwidth to allow reception of television signals in at least three sub-bands, the following values can be used:

- a rectangular printed circuit board PCB of approximately 40 mm×200 mm×1 mm, and made of FR4 material (dielectric permitivity of approximately 4.2 and loss tangent of approximately 0.014),
- a first chosen distance H1 approximately equal to 5 mm,
- a second chosen distance H2 approximately equal to 9 mm,
- a first chosen dimension D1 approximately equal to 20 mm,
- a second chosen dimension D2 approximately equal to 8 mm,
- a chosen dimension D3 approximately equal to 1 mm,
- first P1F, P2S, second P2F, P2S, third P3F, P3S portions of the feed and shorting pins having a width W (FIG. 2) approximately equal to 1 mm,
- a portion of the third part P3S of the shorting pin, parallel to a side of the short portion RE1 of the radiating element, having a length L1 approximately equal to 28 mm,
- another portion of the third part P3S of the shorting pin, parallel to a side of the long portion RE2 of the radiating element, having a length L2 approximately equal to 40 mm.

Figure 3:
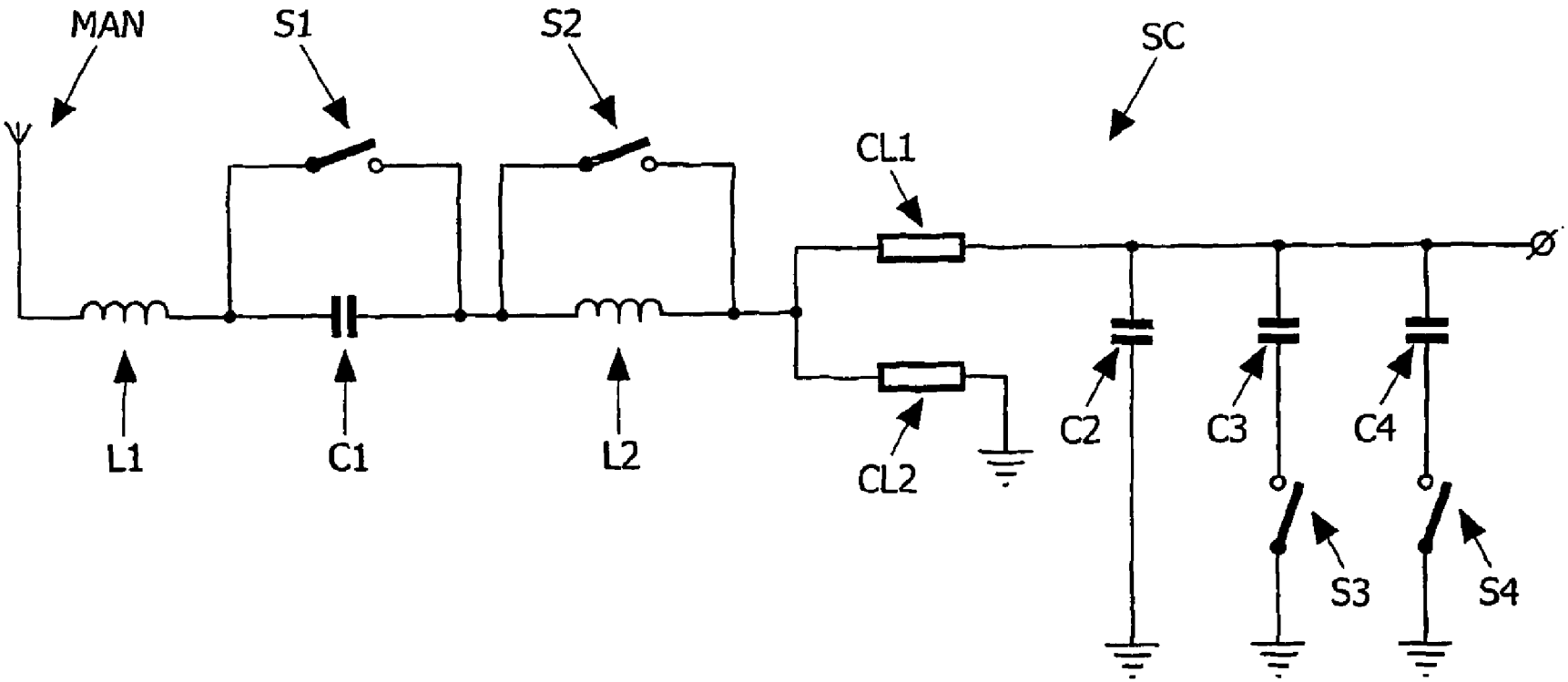

To switch from one sub-band to another, the television receiver R2 may comprise a switching circuit SC such as the one illustrated in FIG. 3.

This switching circuit SC is adapted to an antenna having sufficient bandwidth to be matched at a small number of sub-bands within the total band. It corresponds, for instance, to an antenna MAN installed near the top or bottom of the clam-shell phone UE (FIG. 1).

In the example shown, one of three matching networks is switched in via simple single-pole, single-throw (SPST) switches S1-S4 which could, for example, be PIN diodes, GaAs FETs or MEMS devices ("Micro ElectroMechanical Systems").

At the lowest sub-frequency band SPST switches S1, S3 and S4 are closed while SPST switch S2 is open. The inductors L1 and L2 tune the antenna resonant frequency to the lowest sub-band. At this point the antenna MAN is predominantly series resonant. Two coupled microstrip lines CL1 and CL2 act as an impedance transformer in combination with a shunt inductor not shown. This shunt inductor is tuned out by a shunt capacitor that is made of a combination of three capacitors C2, C3 and C4 mounted in parallel, in this example. This has the effect of double-tuning the antenna MAN, hence increasing the bandwidth.

In the second sub-band SPST switches S2 and S3 are closed while SPST switches S1 and S4 are open.

In the third, highest frequency, sub-band SPST switch S2 is closed while SPST switches S1, S3 and S4 are open. When the SPST switch S1 is open the capacitor C1 tunes the antenna MAN to a higher frequency.

These SPST switches may have an ON resistance of 1Ω and an OFF capacitance of 0.4 pF having a quality factor (Q) approximately equal to 5.

An efficiency greater than 60% may be achieved over the DVB-H band. Greater efficiency could be achieved by increasing the effective height of the antenna MAN (both parallel and perpendicular to the PCB) and by improving the switch losses, for example, using MEMS devices.

It is possible that other circuits be used to cover the TV band by switching over a number of sub-bands. In other words the number of matching networks in the switching circuit depends on the number of sub-bands that are necessary to cover the chosen TV band.

Moreover, varactor diodes can be employed to continuously tune across the band. Each switch may be also combined with a varactor diode.

Figure 4:
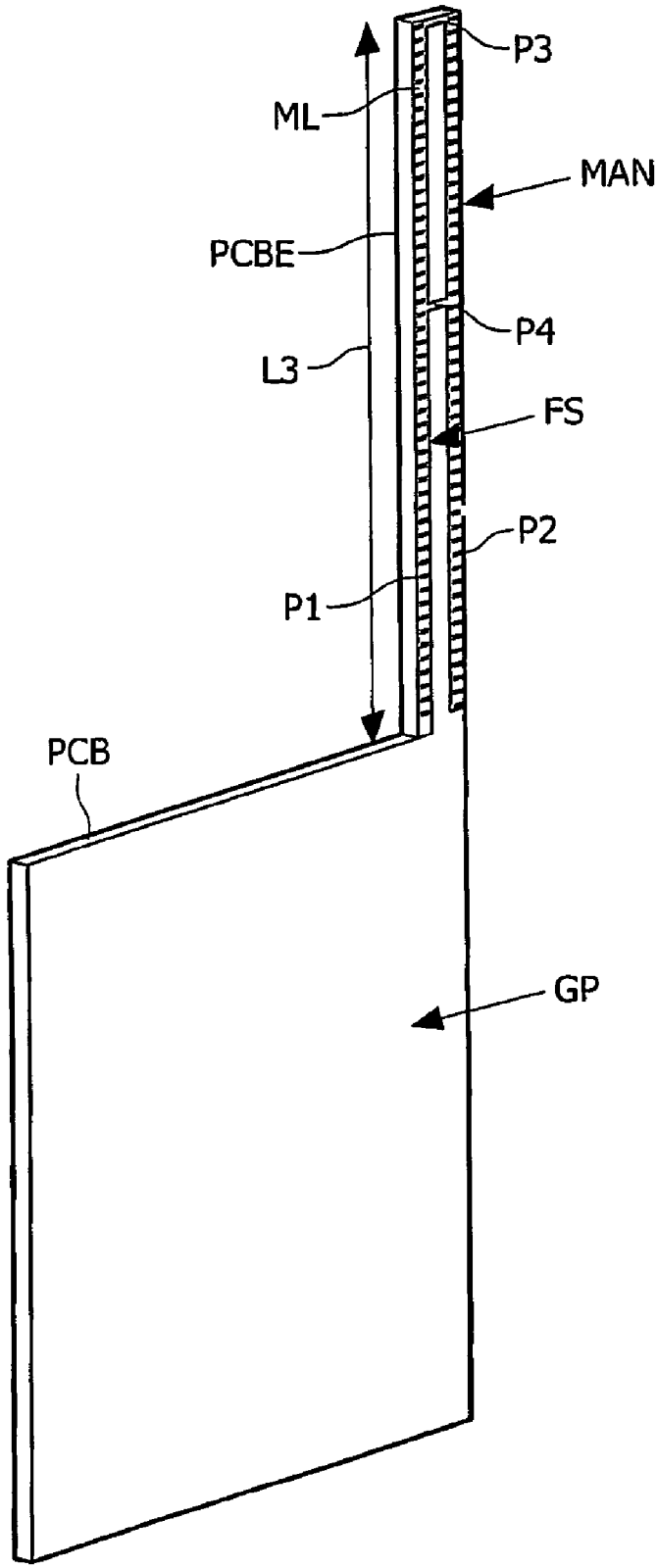
Figure 5:
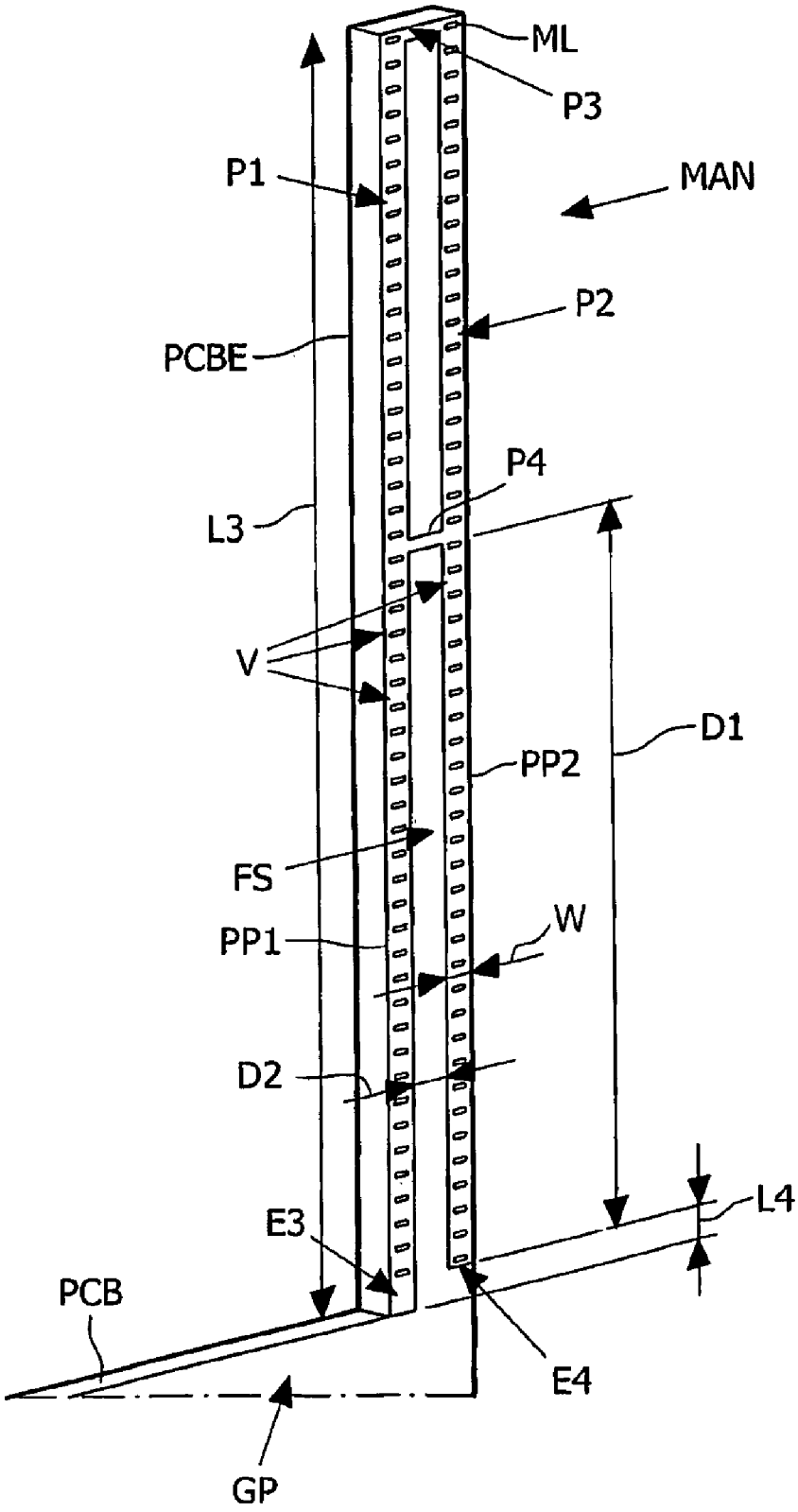

Reference is now made to FIGS. 4 and 5 to describe an example of embodiment of a main single-pole antenna MAN according to the invention.

The illustrated main single-pole antenna MAN comprises a U-shaped conductor ML, which is mounted above the printed circuit board PCB which provides a ground plane GP. More precisely, the printed circuit board PCB comprises a main rectangular part having a narrow extension PCBE above which the U-shaped conductor ML is mounted.

This conductor ML comprises four portions P1-P4.

The first P1 and second P2 portions define the two parallel branches of the U shape. The first portion P1 comprises an extremity E3 connected to the television receiver R2 through a dedicated integrated circuit (not shown) provided on the main rectangular part of the printed circuit board PCB. The second portion P2 comprises an extremity E4 that is not connected to the ground plane GP.

The first portion P1 of the U-shaped conductor ML extends over the whole length L3 of the single-pole antenna MAN.

Preferably the second portion P2 of the U-shaped conductor ML is shorter than its first portion P1 so that the extremity E4 is sufficiently far from the ground plane that it is disconnected (i.e. with minimal capacitance). This difference in length is referenced L4 in FIG. 5.

The third portion P3 defines the perpendicular branch of the U shape. It runs perpendicularly between the extremities of the first and second parallel portions P1, P2 that are opposed to their respective extremities E3 and E4.

The fourth portion P4 is a shorting portion running perpendicular between the first and second parallel portions P1, P2 at an intermediate level located at a first chosen distance D1 of the second portion extremity E4.

With such an arrangement the filtering slot FS is defined between the shorting portion P4 and the parts PP1 and PP2 of the first P1 and second P2 portions of the U-shaped conductor ML, which comprise the extremities E3 and E4. So, in this example the shape of the filtering slot FS is approximately rectangular. But other shapes may be envisaged.

The location of the intermediate level (first distance D1), where the shorting portion P4 stands, can be chosen predominantly to set the correct resonant frequency and then to filter (reject) the GSM signals in the 900 MHz region. The second distance D2 of the filtering slot FS is defined between the first P1 and second P2 portions of the U-shaped conductor ML and can predominantly be used for impedance matching.

When the U-shaped conductor ML is formed on either side of a dielectric support, it preferably comprises a series of vias V distributed over its four portions P1-P4 in order to reduce the power loss in the dielectric part of the printed circuit board PCB. Alternatively, the conductors defining the U-shaped conductor ML is formed from solid metal with minimal supporting dielectric material (to maintain the spacing (or second distance) D2).

These vias are metalized holes, which pass through the printed circuit board PCB and lead to the U-shaped conductor ML provided on one of its faces and to corresponding metalized lines provided on the opposite face.

For the main single-pole antenna MAN to have a sufficient bandwidth to allow reception of television signals, one can use the following values:

- a printed circuit board PCB having a main rectangular portion of approximately 40 mm×100 mm×1 mm and a narrow extension PCBE of approximately 3 mm×100 mm×1 mm, and made of FR4 material,
- a first chosen dimension D1 approximately equal to 59 mm,
- a second chosen dimension D2 approximately equal to 1 nm,
- a length difference L4 approximately equal to 3 mm,
- first P1, second P2, third P3 and fourth P4 portions of the U-shaped conductor ML having a width W approximately equal to 1 mm.

The switching circuit SC illustrated in FIG. 3 may also be used with the single-pole antenna MAN to switch from one sub-band to another.

The invention is not limited to the embodiments of mobile telephone described above, only as examples, but it encompasses all alternative embodiments as for instance, any communication devices not necessarily applied to planar antennae, which may be considered by one skilled in the art within the scope of the claims hereafter.

The invention also relates to an antenna as disclosed above.

The invention claimed is:

1. Mobile telephone, comprising a casing housing a telephone set to receive and transmit radiotelephone signals and a television set comprising a main television antenna to receive radiotelevision signals, a television receiver arranged to process the received radiotelevision signals to output television signals to be displayed, and a display means to display said outputted television signals, characterized in that said main television antenna is made in planar technology, is built-in inside said casing and comprises a filtering slot having chosen dimensions to be resonant around the frequency of said radiotelephone signals to reject them at least partly.

2. Mobile telephone according to claim 1, characterized in that said main television antenna is a Planar Inverted F Antenna comprising:

- a radiating element with an L shape settled in a first plane approximately parallel to a ground plane, located on a face of a printed circuit board, and at a first chosen distance from said ground plane,
- feed and shorting planar pins having i first parts substantially parallel to each other, respectively connected to said television receiver and to said ground plane and running approximately parallel to said ground plane over a second chosen distance, ii second parts substantially parallel to each other and extending from said first parts in a direction approximately perpendicular to said ground plane and over said first chosen distance, and iii third parts extending from said second parts in approximately said first plane and respectively connected to first and second extremities of the short and long portions of said L-shaped radiating element, and having portions running substantially parallel to each other and to the long portion of said L-shaped radiating element,
- said filtering slot being defined between said third part portion of said feed pin, and said short and long portions of said L-shaped radiating element.

3. Mobile telephone according to claim 2, characterized in that said main planar antenna has a bandwidth depending on said first and second chosen distances.

4. Mobile telephone according to claim 3, characterized in that said bandwidth is approximately proportional to the sum of said first and second chosen distances.

5. Mobile telephone according to claim 1, characterized in that said main planar television antenna is of a single-pole type.

6. Mobile telephone according to claim 5, characterized in that said main planar television antenna comprises:

a U-shaped conductor, mounted on a narrow extension of a ground plane located on a face of a printed circuit board, and comprising i first and second parallel portions, having one first portion extremity connected to said television receiver, and ii a shorting portion running approximately perpendicularly between said first and second parallel portions at an intermediate level located at a chosen distance of a second portion extremity, said filtering slot being defined between said shorting portion and parts of said first and second portions comprising their respective first and second portion extremities.

7. Mobile telephone according to claim 6, characterized in that said second portion is shorter than said first portion.

8. Mobile telephone according to claim 6, characterized in that said U-shaped conductor connected to a series of vias arranged to reduce power loss in a dielectric part of said printed circuit board.

9. Mobile telephone according to claim 1, characterized in that it comprises an auxiliary television antenna connected to said television receiver to feed it with received radiotelevision signals.

10. Mobile telephone according to claim 9, characterized in that said auxiliary television antenna is a retractable whip antenna adapted to be housed inside said casing when it is not used.

11. Mobile telephone according to claim 9, characterized in that said auxiliary television antenna is located in a pluggable earphone wire.

12. Mobile telephone according to claim 1, characterized in that it comprises a switching circuit comprising at least one matching network to switch over at least one chosen sub-band of the frequency band received by said main planar television antenna and/or said auxiliary television antenna.

13. Mobile telephone according to claim 12, characterized in that said switching circuit comprises at least three matching networks together comprising switches of the "single pole, single throw" type, adapted to switch over three sub-bands depending on their respective states and combined with inductors and capacitors for tuning the antenna frequency to a central frequency of one of said sub-bands.

14. Mobile telephone according to claim 13, characterized in that said switches are chosen in a group comprising PIN diodes, GaAs FETs and MEMS devices.

15. Mobile telephone according to claim 13, characterized in that each of said switches is combined with a varactor diode.

16. Mobile telephone according to claim 1, characterized in that said casing comprises first and second parts connected one to the other and defining a "clam-shell" structure or a "flip" structure, said first casing part housing a keypad and said second casing part housing said display means.

17. Mobile telephone according to claim 16, characterized in that said second casing part houses said main television antenna.

18. Mobile telephone according to claim 16, characterized in that said first casing part houses said main television antenna.

19. Antenna suitable for any device as mobile telephones as claimed in claim 1.

* * * * *